US011223895B2

(12) United States Patent
Nilsen

(10) Patent No.: US 11,223,895 B2
(45) Date of Patent: Jan. 11, 2022

(54) WEARABLE AUDIO DEVICE WITH COUNTER-BORE PORT FEATURE

(71) Applicant: Bose Corporation, Framingham, MA (US)

(72) Inventor: Thomas Aquinas Nilsen, Auburn, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 16/828,327

(22) Filed: Mar. 24, 2020

(65) Prior Publication Data

US 2021/0306738 A1 Sep. 30, 2021

(51) Int. Cl.
*H04R 1/10* (2006.01)
*H04R 1/28* (2006.01)

(52) U.S. Cl.
CPC ..... *H04R 1/2807* (2013.01); *H04R 1/1016* (2013.01); *H04R 1/1075* (2013.01); *H04R 2201/109* (2013.01)

(58) Field of Classification Search
CPC ..... H04R 1/10; H04R 1/1016; H04R 1/1058; H04R 1/1075; H04R 1/1083; H04R 1/1091; H04R 1/28; H04R 1/2807; H04R 1/2823; H04R 1/2826; H04R 1/2849; H04R 2460/01; H04R 2460/11; G02C 11/06; G02C 11/10
See application file for complete search history.

(56) References Cited

U.S. PATENT DOCUMENTS

| | | | | |
|---|---|---|---|---|
| 5,208,868 | A * | 5/1993 | Sapiejewski | H04R 1/1083 381/338 |
| 6,831,984 | B2 * | 12/2004 | Sapiejewski | H04R 1/2819 181/182 |
| 8,989,427 | B2 * | 3/2015 | Silvestri | H04R 1/2888 381/380 |
| 10,993,009 | B2 * | 4/2021 | Bacon | H04R 1/1058 |
| 2008/0002835 | A1 * | 1/2008 | Sapiejewski | H04R 1/2849 381/71.6 |
| 2012/0201406 | A1 * | 8/2012 | Yamaguchi | H04R 1/1016 381/309 |
| 2013/0343594 | A1 * | 12/2013 | Howes | H04R 1/1016 381/380 |
| 2014/0140565 | A1 * | 5/2014 | Liu | H04R 1/1091 381/380 |

(Continued)

FOREIGN PATENT DOCUMENTS

| | | |
|---|---|---|
| DE | 19529848 C1 | 1/1997 |
| JP | H0732489 A | 2/1995 |

OTHER PUBLICATIONS

PCT International Search Report and Written Opinion for International Application No. PCT/US2021/021308, dated Jun. 14, 2021, 70 pages.

*Primary Examiner* — Thang V Tran
(74) *Attorney, Agent, or Firm* — Hoffman Warnick LLC

(57) ABSTRACT

Various implementations include wearable audio devices with counter-bore port features for maintaining a cover on the port. In certain cases, the wearable audio device includes a port that is integrated into the device frame and acoustically couples one or more acoustic cavities to a distinct volume. The device frame has a counter-bore feature proximate to the port for positioning a metal mesh.

20 Claims, 6 Drawing Sheets

(56) References Cited

U.S. PATENT DOCUMENTS

| | | | | |
|---|---|---|---|---|
| 2016/0192065 | A1* | 6/2016 | Oosato | H04R 1/2826<br>381/378 |
| 2017/0223443 | A1* | 8/2017 | Silvestri | H04R 1/2849 |
| 2018/0338193 | A1 | 11/2018 | Wallace et al. | |
| 2020/0221202 | A1 | 7/2020 | Bacon et al. | |
| 2020/0304905 | A1* | 9/2020 | Oishi | H04R 1/025 |

* cited by examiner

WEARABLE AUDIO DEVICE WITH COUNTER-BORE PORT FEATURE

TECHNICAL FIELD

This disclosure generally relates to wearable audio devices. More particularly, the disclosure relates to wearable audio devices with at least one feature for retaining a cover over an acoustic port.

BACKGROUND

Wearable audio devices in various form factors (e.g., headphones, earphones/earbuds, audio eyeglasses and other head-worn audio devices) have acoustic cavities with one or more ports. Covering these ports helps to prevent external particulate and moisture from entering the acoustic cavities. However, the ports should be covered in such a way as to minimize impact on acoustic output. This can be particularly challenging in smaller-scale applications such as in earbuds or audio eyeglasses.

SUMMARY

All examples and features mentioned below can be combined in any technically possible way.

Various implementations of the disclosure include wearable audio devices with counter-bore port features for maintaining a cover on the port. In certain cases, the wearable audio device includes a port that is integrated into the device frame and acoustically couples one or more acoustic cavities to a distinct volume. The device frame has a counter-bore feature proximate to the port for positioning a metal mesh.

In some particular aspects, a wearable audio device includes: a frame comprising a first acoustic cavity and a second acoustic cavity; an electro-acoustic transducer within the frame and configured to deliver acoustic energy into the first and second acoustic cavities; a port integrated in the frame that acoustically couples one of the first or second acoustic cavities to a different volume; a counter-bore feature in the frame adjacent to the port; and a metal mesh covering the port and positioned proximate to the counter-bore feature.

In other particular aspects, a wearable audio device includes: a frame having a first acoustic cavity and a second acoustic cavity; an electro-acoustic transducer within the frame and configured to deliver acoustic energy into the first and second acoustic cavities; a port integrated in the frame that acoustically couples one of the first or second acoustic cavities to a different volume; a counter-bore feature in the frame adjacent to the port; a rib adjacent to the counter-bore feature; and a metal mesh covering the port and attached through the rib proximate to the counter-bore.

In additional particular aspects, a method includes: forming a frame for a wearable audio device including a port opening and a counter-bore feature at least partially surrounding the port opening; placing a metal mesh over the port opening proximate to the counter-bore feature; and heat staking the metal mesh into the frame around the port opening such that at least a portion of the frame melts during the heat staking and is collected in the counter-bore feature without entering the port opening.

Implementations may include one of the following features, or any combination thereof.

In certain implementations, the counter-bore feature includes a ledge in the frame extending at least partially annularly around the port, where the ledge is defined by a recess in adjacent walls of the frame, and where the ledge is located radially inboard of a stake location of the metal mesh relative to a primary axis of the port.

In some cases, the ledge extends around an entire annulus of the port.

In particular aspects, the frame includes plastic, the metal mesh is directly bonded to the plastic proximate to the counter-bore feature by heat staking, where the counter-bore feature mitigates melting of the plastic into the port during the heat staking.

In certain implementations, the direct bond between the metal mesh and the plastic proximate the counter-bore feature mitigates occlusion of the port.

In some aspects, the port acoustically couples the first and second cavities.

In particular cases, the frame includes an annular seat for the electro-acoustic transducer, and an integral extension that includes the port.

In certain aspects, the port acoustically couples one of the first acoustic cavity or the second acoustic cavity to an environment external to the wearable audio device, where the port includes a nozzle that is configured to deliver acoustic energy into an ear canal of a user of the wearable audio device.

In some implementations, the first acoustic cavity is located proximate a front of the wearable audio device and the second acoustic cavity is located proximate a rear of the wearable audio device.

In particular aspects, the wearable audio device includes an earbud, where the electro-acoustic transducer has an outer dimension equal to or less than approximately 10 millimeters (mm) to approximately 20 mm.

In some cases, the port is located in an outer wall of the frame, and the rib extends from the outer wall of the frame and is located radially outboard of the counter-bore feature relative to a primary axis of the port.

In particular implementations, the frame further includes a rib extending from a wall proximate the port opening, where the heat staking includes heat staking the metal mesh into the rib, and where at least a portion of the rib melts during the heat staking and is collected in the counter-bore feature without entering the port opening.

Two or more features described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

Figure 1:
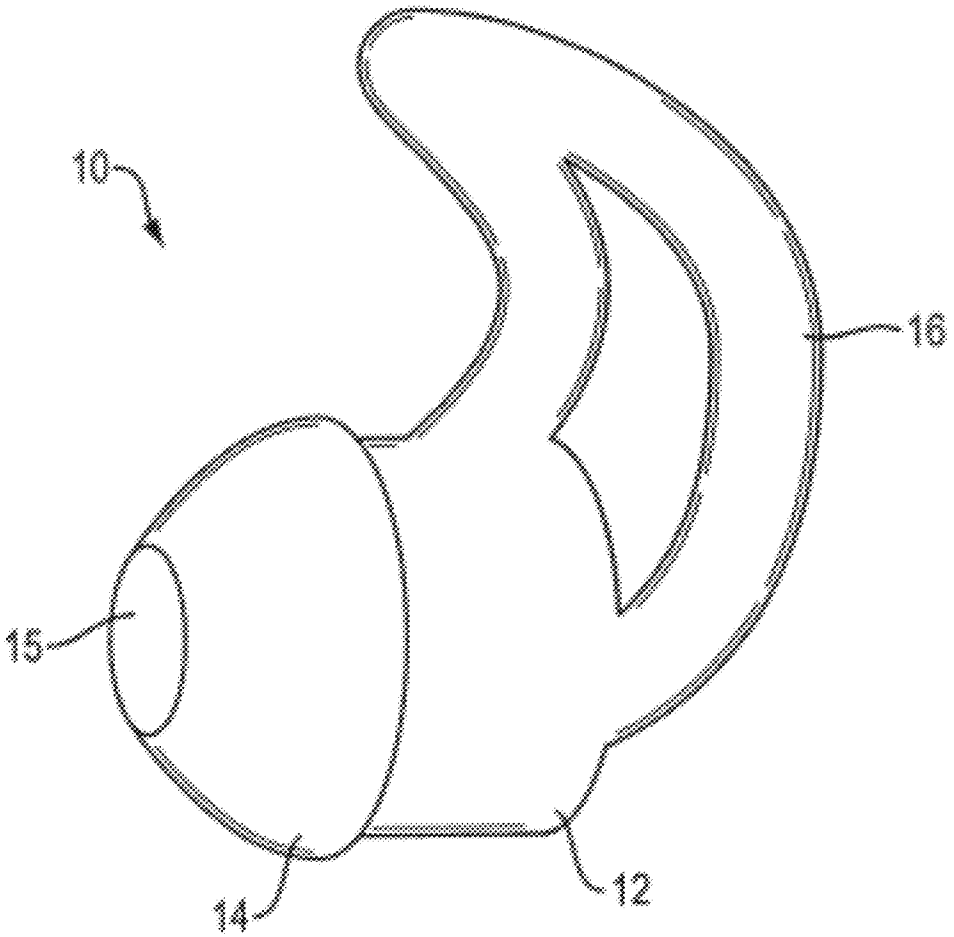
FIG. 1 shows a schematic depiction of a wearable audio device according to various implementations.

It is noted that the drawings of the various implementations are not necessarily to scale. The drawings are intended to depict only typical aspects of the disclosure, and therefore should not be considered as limiting the scope of the invention. In the drawings, like numbering represents like elements between the drawings.

DETAILED DESCRIPTION

As noted herein, various aspects of the disclosure generally relate to wearable audio devices such as earphones (e.g., earbuds) or audio eyeglasses. More particularly, aspects of the disclosure relate to wearable audio devices having a counter-bore feature for retaining a metal mesh over an acoustic port. In some cases, the wearable audio device also includes a rib for aiding in mounting and/or retention of the metal mesh.

Commonly labeled components in the FIGURES are considered to be substantially equivalent components for the purposes of illustration, and redundant discussion of those components is omitted for clarity. Numerical ranges and values described according to various implementations are merely examples of such ranges and values, and are not intended to be limiting of those implementations. In some cases, the term "approximately" is used to modify values, and in these cases, can refer to that value +/− a margin of error, such as a measurement error. It is understood that the terms "inboard" and "outboard" are used to describe the radial location of components relative to the central axis (A), such that relative to the axis (A), a component that is radially inboard of a distinct component is closer to the central axis (A) on a radial (perpendicular) line that extends from the axis (A). The term "radially oriented" can be used to refer to a component, line, or plane that is perpendicular to an axis such as a central axis (A).

Components shown and described herein can be formed according to various manufacturing techniques, for example, molding, casting, additive manufacturing (e.g., 3D printing), etc. Where specific techniques are not described, conventional manufacturing approaches can be used to form the components and structures disclosed according to various implementations.

Aspects and implementations disclosed herein may be applicable to a wide variety of speaker systems, such as wearable audio devices in various form factors, with particular application to earphones (e.g., earbuds), audio eyeglasses or other head-mounted audio devices. Unless specified otherwise, the term wearable audio device, as used in this document, includes headphones and various other types of personal audio devices such as head, shoulder or body-worn acoustic devices that include one or more acoustic drivers to produce sound, with or without contacting the ears of a user. Some aspects disclosed may be particularly applicable to personal (wearable) audio devices such as in-ear earphones (also called, earbuds) and audio eyeglasses. It should be noted that although specific implementations of speaker systems primarily serving the purpose of acoustically outputting audio are presented with some degree of detail, such presentations of specific implementations are intended to facilitate understanding through provision of examples and should not be taken as limiting either the scope of disclosure or the scope of claim coverage.

Aspects and implementations disclosed herein may be applicable to speaker systems that either do or do not support two-way communications, and either do or do not support active noise reduction (ANR). For speaker systems that do support either two-way communications or ANR, it is intended that what is disclosed and claimed herein is applicable to a speaker system incorporating one or more microphones disposed on a portion of the speaker system that remains outside an ear when in use (e.g., feedforward microphones), on a portion that is inserted into a portion of an ear when in use (e.g., feedback microphones), or disposed on both of such portions. Still other implementations of speaker systems to which what is disclosed and what is claimed herein is applicable will be apparent to those skilled in the art.

The wearable audio devices disclosed herein can include additional features and capabilities not explicitly described. That is, the wearable audio devices described according to various implementations can include features found in one or more other wearable electronic devices, such as smart glasses, smart watches, etc., or any other wearable audio device. These wearable audio devices can include additional hardware components, such as one or more cameras, location tracking devices, microphones, etc., and may be capable of voice recognition, visual recognition, and other smart device functions. The description of wearable audio devices included herein is not intended to exclude these additional capabilities in such a device.

As described herein, small-scale wearable audio devices present challenges in terms of the trade-off between effectively covering acoustic port(s) and minimizing impact on acoustic output. That is, selection of appropriate material(s) and approaches for covering acoustic ports can be challenging as the size of those ports decreases. Various implementations include wearable audio devices with at least one feature for retaining an acoustic port cover. In certain implementations, the feature can enhance the manufacturing process, e.g., the process of applying the port cover, without sacrificing acoustic performance or structural stability.

In particular cases, the port is covered with a metal mesh. The metal mesh provides consistent manufacturability without sacrificing acoustic performance. This is in contrast to conventional port covers that use composite materials and have undesirable manufacturing variations and/or sacrifice acoustic performance. In various example implementations, the port(s) is covered with metal mesh having a Ray1 value of approximately 10 to approximately 60. In some implementations, the metal mesh used to cover distinct ports can have distinct Ray1 values, which can vary based on the size of the ported acoustic volume and/or the size of the transducer (e.g., a larger transducer and/or ported volume is paired with metal mesh having a higher Ray1 value). In a particular group of non-limiting examples, one or more ports is covered with a metal mesh having a Ray1 value of approximately 35-45. In various implementations, the metal mesh is made of steel such as stainless steel. The wearable audio devices according to various implementations include a counter-bore feature for coupling the metal mesh to the device frame. In various implementations, that frame is made of a plastic or a composite material. The counter-bore feature allows the metal mesh to be effectively coupled to the frame without disrupting the acoustic cavity.

FIG. 1 is a perspective view of a wearable audio device 10 according to various implementations. In the example depicted in FIG. 1, the wearable audio device 10 is an in-ear headphone, earphone, or earbud. As shown in this (earbud) example, the wearable audio device 10 includes a body 12 that houses the active components of the earbud. An ear tip portion 14 is coupled to body 12 and is pliable so that it can be inserted into at least the entrance of the user's ear canal. Sound is delivered through opening 15. Retaining loop 16 is constructed and arranged to be positioned in the outer ear, for example in the antihelix, to help retain the earbud in the ear. Various additional features of earphones and earbuds are disclosed in U.S. Pat. Nos. 9,854,345 and 8,989,427, the disclosures of which are incorporated herein by reference in their entirety and for all purposes. As such, certain details of the earbud are not further described herein. An earbud is an example of an earphone according to this disclosure, but is not limiting of the scope, as earphones can also be located on or over the ear, or even on the head near the ear (also referred to as "near-ear"). Additionally, wearable audio devices in various form factors can utilize aspects of the implementations disclosed herein.

Figure 2:
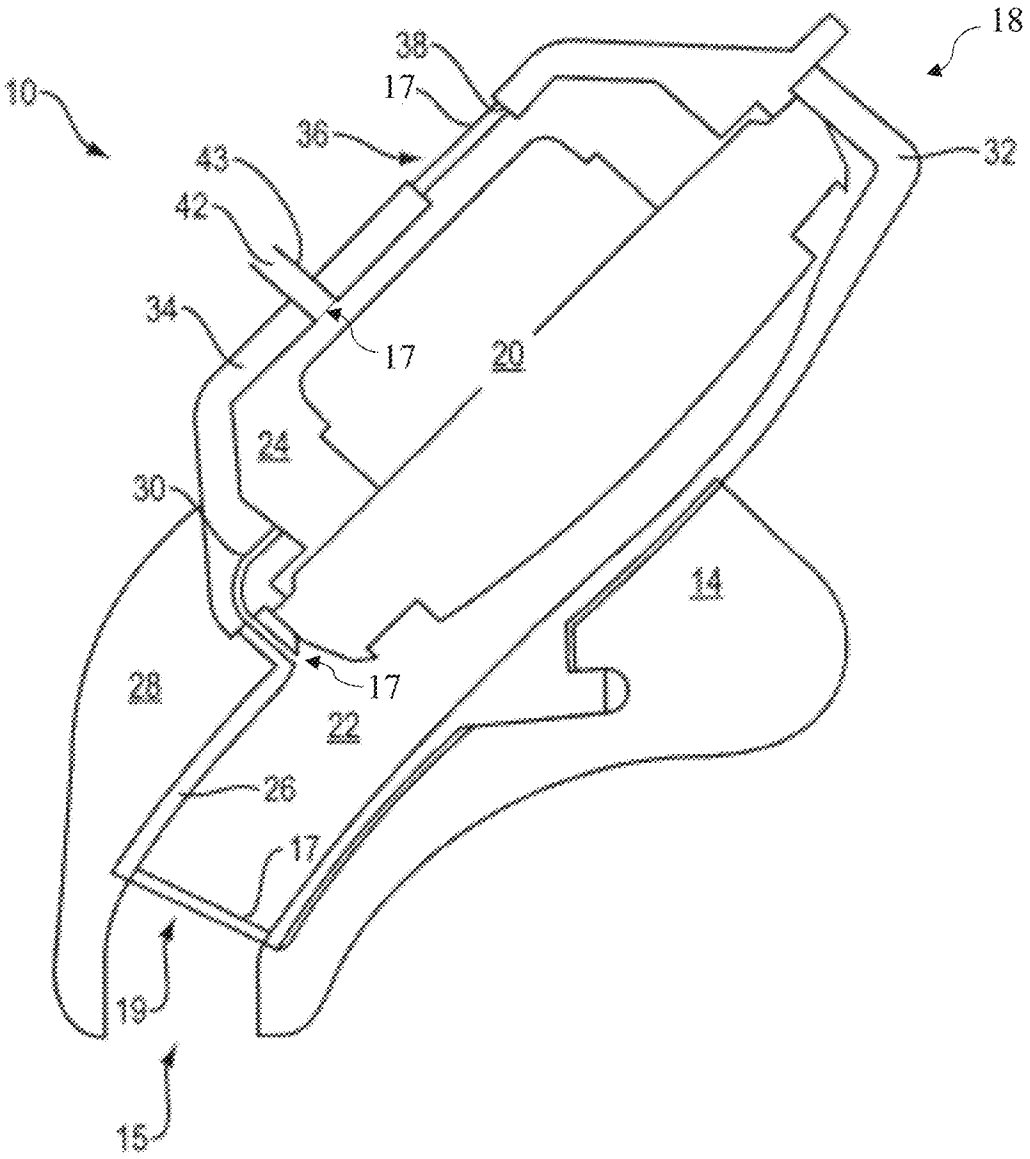
FIG. 2 is a cross-sectional depiction of a portion of the wearable audio device of FIG. 1.

Continuing with the earbud example of wearable audio device (or simply, device) 10 depicted in FIG. 1, FIG. 2 shows internal components of the device 10. In these cases, the wearable audio device (earbud) 10 includes a frame 18 having a front acoustic cavity (or, chamber) 22 and a rear acoustic cavity (or, chamber) 24. In various implementations, the frame 18 is defined by frame shells 32 and 34, respectively, on either side of an electro-acoustic transducer 20. Note that in the drawings and the following description, non-limiting values of some variables are used. These values represent specific non-limiting examples, it being understood that the disclosure is in no way limited by these examples. In some examples, a transducer with an approximately 20 millimeter (mm) or smaller outer dimension can be used (e.g., having an outer diameter that is less than 20 mm), and in particular cases, an approximately 14.8 mm or approximately 9.7 mm (outer) diameter electro-acoustic transducer can be used. Other sizes and types of electro-acoustic transducers could be used depending, for example, on the desired frequency response and performance of the device 10. The electro-acoustic transducer 20 separates the front and rear acoustic cavities 22 and 24.

The shell 32 of the frame 18 extends the front cavity 22 via nozzle 26 to at least the entrance to the ear canal 28, and in some examples into the ear canal 28, through the ear tip portion 14 and ends at an opening 15. In one example, the opening 15 includes a metal mesh 17. In some examples, the metal mesh 17 is located within nozzle 26 rather than at the end, as illustrated in FIG. 2. In certain implementations, the metal mesh 17 acts as an acoustic resistance element that dissipates a proportion of acoustic energy that impinges on or passes through it. In some implementations, the metal mesh 17 acts a screen to prevent or inhibit moisture or debris from entering the front cavity 22. In this example implementation, the front cavity 22 does not have a pressure equalization (PEQ) port to connect the cavity 22 to an environment external to the earphone.

As also shown in FIG. 2, in some implementations, a PEQ port (or simply, port) 30 acoustically couples the front acoustic cavity 22 and the rear acoustic cavity 24. The port 30 serves to relieve air pressure that could be built up within the ear canal 28 and front cavity 22 when (a) the device 10 is inserted into or removed from the ear canal, (b) a person wearing the device 10 experiences shock or vibration, or (c) the device 10 is struck or repositioned while being worn. In some cases, the port 30 has a diameter of between about 0.25 mm to about 3 mm. In particular examples, the port 30 has a length of between about 0.25 mm to about 10 mm. In certain implementations, the port 30 is covered with a metal mesh 17, e.g., to alter the impedance of the port 30 and/or provide environmental protection.

In certain implementations, the port 30 mitigates overpressure conditions when, e.g., the device 10 is inserted into or removed from the user's ear, or during other use of the device 10. Pressure built up in the front acoustic cavity 22 escapes to the rear acoustic cavity 24 via the port 30, and from there to the environment via back cavity ports 42 and 36, e.g., to a mass port 42. In certain example implementations, mass port 42 is also covered with a metal mesh 17, as shown in FIG. 2. Additionally, the port 30 can be used to provide a tuned amount of leakage that acts in parallel with other leakage that may be present. This may help to standardize response across individuals. Additional aspects of the port 30 are described in U.S. patent application Ser. No. 16/241,144 ("Earphone", filed on Jan. 7, 2019), which is incorporated by reference herein in its entirety.

As is also shown in FIG. 2, the rear cavity 24 is sealed around the back side of the electro-acoustic transducer 20 by the frame 18 (e.g., the shell 34 portion of frame 18), except that the rear cavity 24 includes one or both of a reactive element, such as a port (also referred to as a mass port) 42, and a resistive element, which may also be formed as a port 36. In certain implementations, the reactive element 42 and the resistive element 36 acoustically couple the rear acoustic cavity 24 with an environment external to the device 10, thereby relieving air pressure. U.S. Pat. No. 6,831,984 describes the use of parallel reactive and resistive ports in a headphone device, and is incorporated herein by reference. Although referred to as reactive or resistive, in practice any port will have both reactive and resistive effects. In some cases, the term used to describe a given port indicates which effect is dominant. For example, a reactive port like the port 42 is, for example, a tube-shaped opening in what may otherwise be a sealed acoustic cavity or chamber, in this case rear cavity 24. A resistive element like the port 36 can be, for example, a small opening 38 in the frame 18 (e.g., shell portion 34) of acoustic cavity 24, covered by a metal mesh 17 that provides an acoustical resistance, that allows some air and acoustic energy to pass through the wall of the cavity 24.

Figure 3:
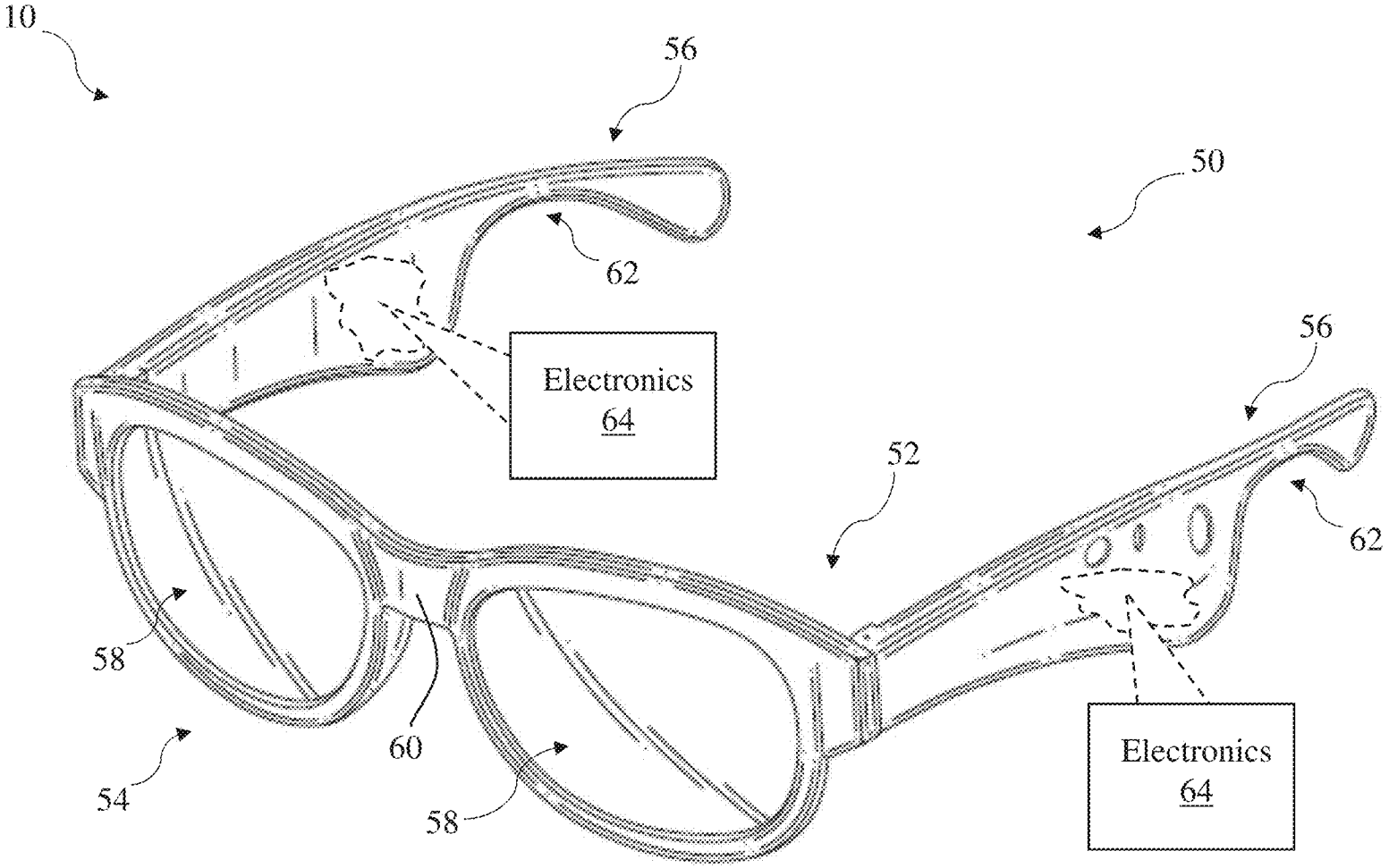
FIG. 3 is a schematic depiction of a wearable audio device according to various further implementations.

FIG. 3 shows an additional implementation of wearable audio device 10. In this example implementation, the wearable audio device (or simply, device) 10 is a pair of audio eyeglasses 50. As shown, the device 10 can include a frame 52 having a first section (e.g., lens section) 54 and at least one additional section (e.g., arm sections) 56 extending from the first section 54. In this example, as with conventional eyeglasses, the first (or, lens) section 54 and additional section(s) (arms) 56 are designed for resting on the head of a user. In this example, the lens section 54 can include a set of lenses 58, which can include prescription, non-prescription and/or light-filtering lenses, as well as a bridge 60 (which may include padding) for resting on the user's nose. Arms 56 can include a contour 62 for resting on the user's respective ears.

Contained within the frame 52 (or substantially contained, such that a component can extend beyond the boundary of the frame) are electronics 64 and other components for controlling the wearable audio device 10 according to particular implementations. In some cases, separate, or duplicate sets of electronics 64 are contained in portions of the frame, e.g., each of the respective arms 56 in the frame 52. However, certain components described herein can also be present in singular form.

Electronics 64 not specifically shown can include one or more electro-acoustic transducer(s) 20 (e.g., as illustrated in FIG. 2). Additionally, one or more portions of the frame 52 can include port(s) such as those describe with reference to device 10 in FIG. 2. That is, similar to the audio device 10 depicted in FIG. 2, in various implementations, the audio eyeglasses shown in FIG. 3 can include: acoustic cavities within the frame 52, an electro-acoustic transducer 20 configured to deliver acoustic energy into the acoustic cavities, and a port integrated into the frame 52 that couples the acoustic cavities. As noted herein, the device 10 can take additional forms and remain in keeping with the various implementations.

Figure 4:
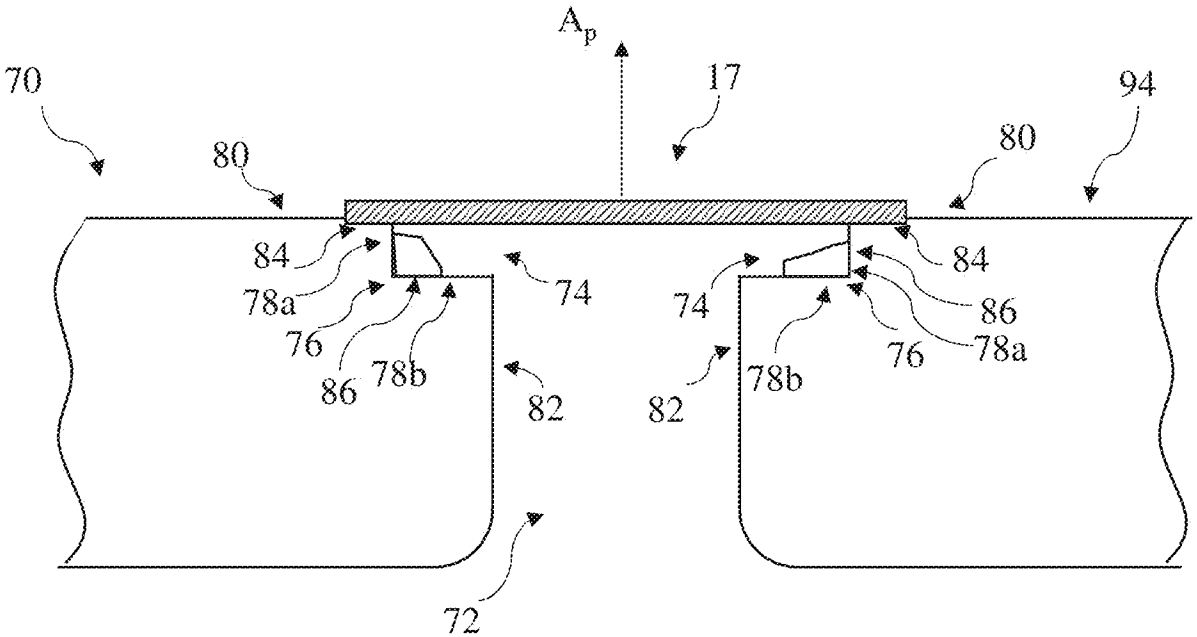
FIG. 4 shows a partial cross-sectional view of a frame in a wearable audio device according to various implementations.

FIG. 4 shows a close-up cross-sectional view of a portion of a device frame 70 (e.g., similar to device frame 18 in earbud example of FIG. 2, and/or device frame 52 in audio eyeglasses example of FIG. 3). A port 72 (e.g., similar to ports 30, 36 and/or 42 in FIG. 2) is shown integrated into the frame 70. In various implementations, the frame 70 has a counter-bore feature 74 adjacent to the port 72. A metal mesh 17 (e.g., similar to the metal mesh shown and described with reference to FIG. 2) is shown covering the port 72 and positioned proximate to the counter-bore feature 74. In particular implementations, the metal mesh 17 is staked to the frame 70 proximate to the counter-bore feature 74.

In various implementations, the counter-bore feature 74 includes a ledge 76 in the frame 70 that extends at least partially annularly around the port 72. In certain cases, the ledge 76 extends annularly around the port 72, e.g., by at least 180 degrees or at least 270 degrees. In some particular cases, the ledge 76 extends entirely (or nearly entirely) annularly around the port 72. The ledge 76 is defined by a recess 78 in adjacent walls 80, 82 of the frame 70. In this case, recesses 78 in separate walls are denoted by (a) and (b). As shown, in some cases, the ledge 76 is located radially inboard of a stake location 84 of the metal mesh 17 relative to a primary axis ($A_p$) of the port 72. In certain cases, the stake location 84 is the location at which the metal mesh 17 is bonded to the frame 70, and can include a plurality of locations annularly positioned around the port 72. A continuous annular bond (stake) can be formed in certain implementations, however, in other cases, the metal mesh 17 is bonded to the frame 70 at a plurality of distinct (separate) locations annularly positioned around the port 72. In particular cases, the metal mesh 17 is directly bonded to the frame 70 proximate the counter-bore feature 74. In certain examples, frame 70 includes plastic (e.g., 30% glass filled nylon), and the metal mesh 17 is bonded to the frame 70 by heat staking.

In particular implementations, heat staking the metal mesh 17 to the frame 70 is performed separately from forming the frame 70. However, in other implementations, the metal mesh 17 is heat staked to the frame 70 as part of a method of manufacturing one or more portions of the device 10. In certain cases, a manufacturing process can include: (i) forming the frame 70 including a port (opening) 72 and the counter-bore feature 74 at least partially surrounding the port 72 (e.g., using plastic molding); (ii) placing the metal mesh 17 (which can, for example, be pre-machined to size) over the port 72 proximate the counter-bore feature 74; and (iii) heat staking the metal mesh 17 into the frame 70 around the port 72. In some cases, at least a portion of the frame 70 melts during the heat staking, and is collected in the counter-bore feature 74 without entering the port opening 72. More particularly, heat staking involves positioning the metal mesh 17 at the stake location(s) 84, heating the plastic of the frame 70 to a temperature above the glass transition temperature using super-heated air and/or a thermode, and applying pressure to deform the plastic such that the metal mesh 17 is bonded to the frame 70 at the stake location(s) 84.

As noted herein, the counter-bore feature 74 can mitigate melting plastic from the frame 70 entering into the port 72 during the heat staking process. Examples of melted plastic 86 are illustrated in different forms in FIG. 4, e.g., collected in the counter-bore feature 74. That is, the metal mesh 17 can be heat staked to the plastic in the frame 70 without seepage of that plastic material into the opening in the port 72. In various implementations, when the plastic proximate to the stake location(s) 84 melts during heat staking, that plastic flows into the counter-bore feature 74 (e.g., recess), gathers and cools without seepage into the port 72. The size (e.g., volume) of the counter-bore feature 74 (e.g., recess) after heat staking can vary based on the amount of plastic 86 that melts and flows therein. In certain cases, the shape of the counter-bore feature 74 varies based on the amount of plastic 86 that melts into the recess.

In other words, the direct bond between the metal mesh 17 and the plastic proximate the counter-bore feature 74 mitigates occlusion of the port 72. That is, the metal mesh 17 can be effectively bonded to the frame 70 in such a way as to provide an environmental barrier between acoustic cavities and/or between an acoustic cavity and an external environment, without occluding the port 72.

Figure 5:
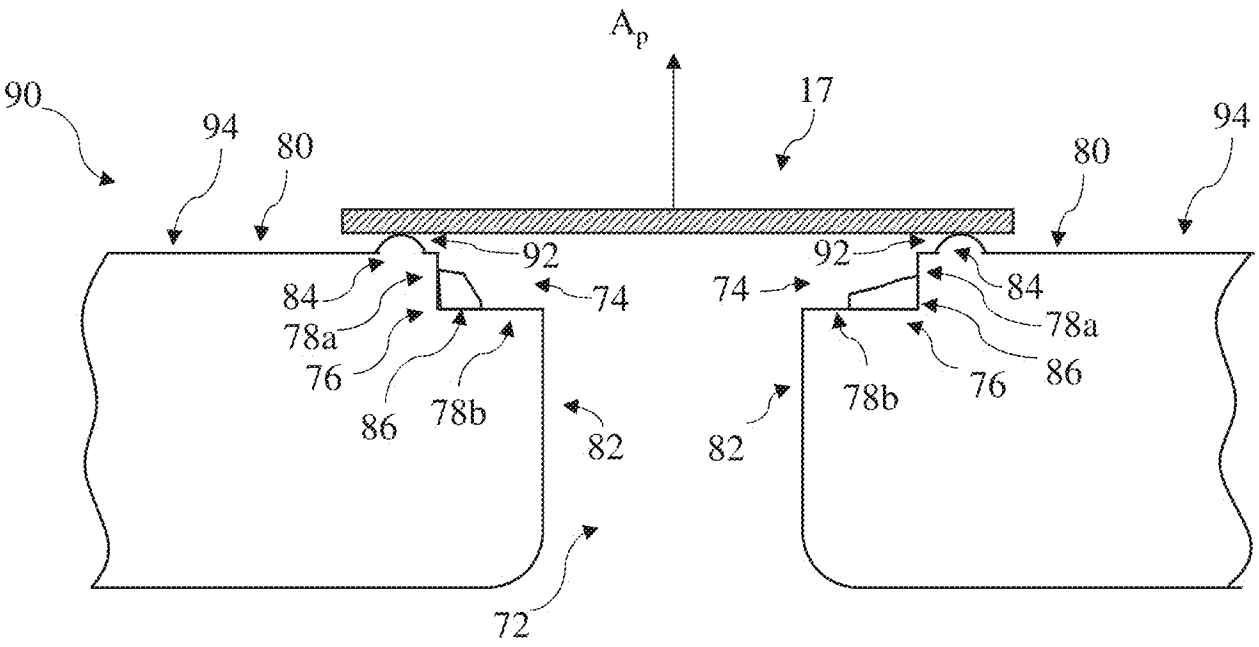
FIG. 5 shows a partial cross-sectional view of a frame in a wearable audio device according to various additional implementations.
Figure 6:
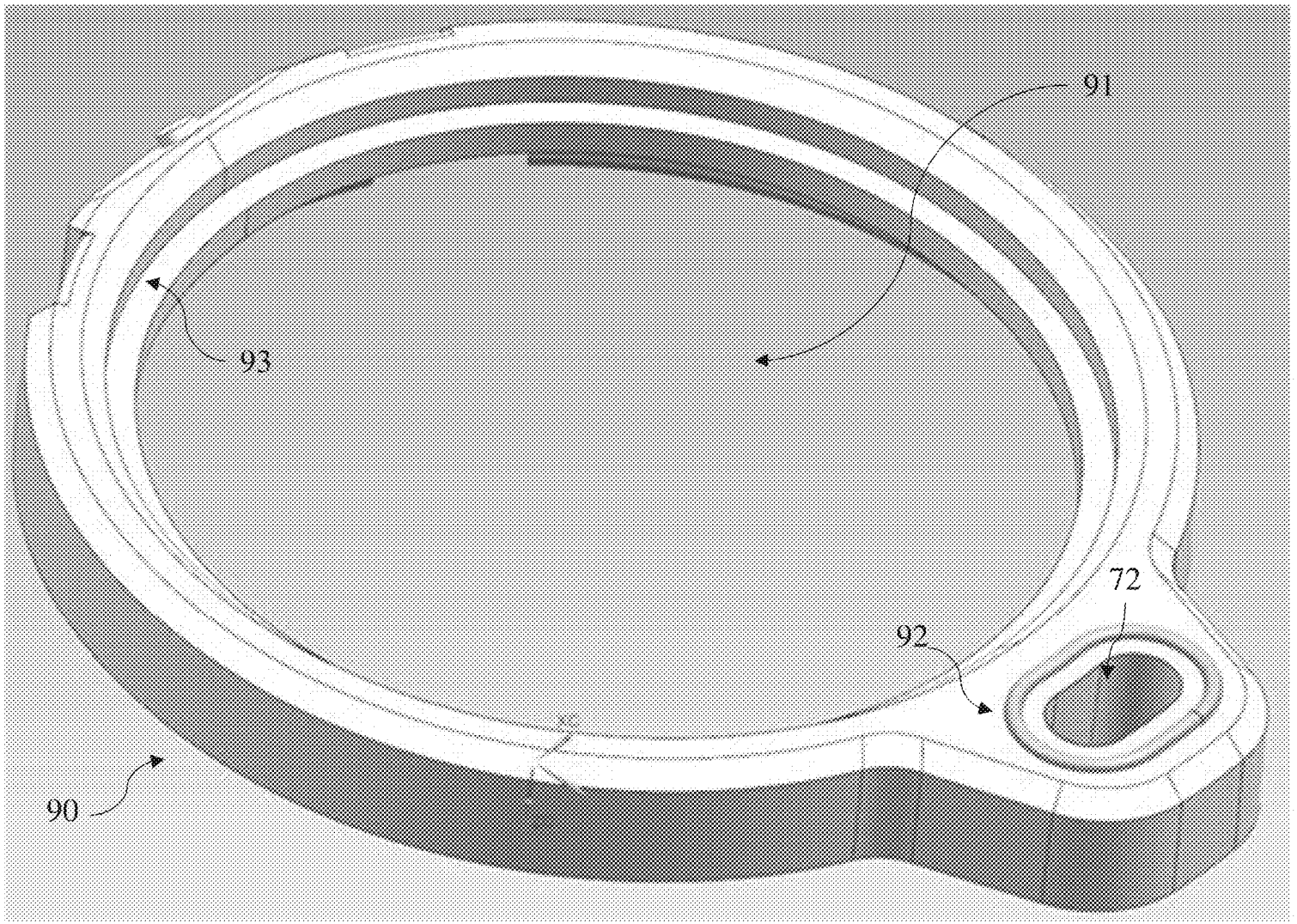
FIG. 6 shows a perspective view of a portion of a wearable audio device frame according to various implementations.

FIG. 5 illustrates an additional implementation of a frame 90 for a device (e.g., device 10) that includes a rib 92 (also referred to as an "energy director") adjacent to a counter-bore feature 74 proximate the port 72. In these cases, the rib (or, energy director) 92 includes one or more ribs that are positioned at the stake location(s) 84. In particular implementations, rib(s) 92 extend at least partially annularly, e.g., by 30, 60, 90 or more degrees each. In some examples, a single rib 92 extends around an entire annulus (or nearly an entire annulus) of the port 72. FIG. 6 shows a schematic perspective view of frame 90, including the single rib 92 extending around an entire annulus of port 72. In this particular example, the port 72 can include a PEQ (or similar) port in the frame 90, e.g., where the frame 90 additionally includes an opening 91 with an annular seat 93 for accommodating a transducer (not shown). The metal mesh 17 is not depicted in FIG. 6.

Returning to FIG. 5, in particular implementations, each rib 92 includes a build-up of material (e.g., plastic) that extends beyond an outer surface 94 of the frame 90 along the direction of the primary axis ($A_p$). That is, the rib 92 protrudes from the outer surface 94 of the frame 90. In some cases, such as where the port 72 is located in an outer wall of the frame 90, the rib 92 extends from the outer wall and is located radially outboard of the counter-bore feature 74 relative to the primary axis ($A_p$) of the port 72. In certain cases, the rib 92 has uniform thickness across its length (measured in a direction parallel with $A_p$). However, in other cases, the rib 92 tapers as it extends away from the outer surface 94 of the frame 90. In additional cases, the rib 92 has one or more rounded or beveled edges, e.g., as shown in the example depictions in FIGS. 5 and 6. In other cases, the rib 92 has a substantially squared profile, triangular profile, or trapezoidal profile, e.g., viewed from the cross-section in FIG. 5. Other profiles are also possible in keeping with the various disclosed implementations. In some implementations, the rib 92 is integral with the frame 70, such that the rib 92 is formed during formation of the frame 90 or is otherwise integrated into the frame 90. In other cases, the rib 92 is formed separately from the frame 90 and is added (e.g., adhered, affixed or placed) to the frame 90 after it is formed. In various implementations, the rib 92 is plastic with a substantially identical composition as the nearby portions of the frame 70.

With continuing reference to FIG. 5, in particular implementations, the metal mesh 17 covers the port 72 and is attached through the rib 92 to the frame 70. In certain cases, the metal mesh 17 is directly bonded to the plastic at the rib 92 proximate to the counter-bore feature 74 by heat staking. This heat staking process can be similar to the process of heat staking the metal mesh 17 directly to the outer surface 94 of the frame 90 as described with reference to FIG. 4, except that in the case where the frame 90 includes the rib 92, the metal mesh 17 is positioned over the rib 92 so that stake locations 84 coincide with the locations of the rib(s) 92. As staking occurs, it is understood that some portion of the rib 92 melts and flows toward the counter-bore feature 74, where it may gather and cool without occluding the port 72. This melted portion of the rib 92 is illustrated as plastic 86 in FIG. 5. That is, in various implementations, the counter-bore feature 74 and the rib(s) 92 mitigate melting of the plastic into the port 72 during the heat staking process. In these cases, the direct bond between the metal mesh 17 and the plastic at the rib 92 can mitigate occlusion of the port 72. In certain cases, a portion of the rib 92 remains after heat staking, such that at least a portion of the metal mesh 17 is separated from the outer surface 94 of the frame 90 (in a direction parallel to the primary axis ($A_p$).

In particular examples, e.g., where the port 92 is in the outer wall of the frame, after heat staking, the outer surface of the metal mesh 17 only minimally protrudes from the outer surface 94 of the frame (e.g., wall 80). In these example cases, whether the rib 92 is present (FIG. 5) or the counter-bore feature 74 is used without the rib 92 (FIG. 4), after heat staking, the outer surface of the metal mesh 17 protrudes from the outer surface 94 of the frame by less than approximately one-tenth of a millimeter, e.g., by approximately 0.1 mm or less, 0.05 mm or less, or 0.03 mm or less.

In any case, wearable audio devices disclosed according to implementations can include a counter-bore feature and/or a rib that aids in placement and bonding of a metal mesh over a ported acoustic cavity. When compared with conventional devices and approaches, the counter-bore feature(s) and rib(s) can improve manufacturability of wearable audio devices while providing improved protection of electronic and acoustic components in those devices.

While various implementations described herein refer to wearable audio devices in the form of earphones (e.g., earbuds) and audio eyeglasses, it is understood that the disclosed principles can be equally applied to a number of wearable audio devices in different form factors.

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

Other embodiments not specifically described herein are also within the scope of the following claims. Elements of different implementations described herein may be combined to form other embodiments not specifically set forth above. Elements may be left out of the structures described herein without adversely affecting their operation. Furthermore, various separate elements may be combined into one or more individual elements to perform the functions described herein.

I claim:

1. A wearable audio device, comprising:

a frame comprising a first acoustic cavity and a second acoustic cavity;

an electro-acoustic transducer within the frame and configured to deliver acoustic energy into the first and second acoustic cavities;

a port integrated in the frame that acoustically couples one of the first or second acoustic cavities to a different volume;

a counter-bore feature in the frame adjacent to the port; and a metal mesh covering the port and positioned proximate to the counter-bore feature, wherein the counter-bore feature mitigates melting plastic from the frame entering into the port during a heat staking process.

2. The wearable audio device of claim 1, wherein the counter-bore feature comprises a ledge in the frame extending at least partially annularly around the port, wherein the ledge is defined by a recess in adjacent walls of the frame, and wherein the ledge is located radially inboard of a stake location of the metal mesh relative to a primary axis of the port.

3. The wearable audio device of claim 2, wherein the ledge extends around an entire annulus of the port.

4. The wearable audio device of claim 1, wherein the frame comprises plastic, and wherein the metal mesh is directly bonded to the plastic proximate to the counter-bore feature by the heat staking process.

5. The wearable audio device of claim 4, wherein the direct bond between the metal mesh and the plastic proximate the counter-bore feature mitigates occlusion of the port.

6. The wearable audio device of claim 1, wherein the port acoustically couples the first and second cavities.

7. The wearable audio device of claim 1, wherein the frame comprises an annular seat for the electro-acoustic transducer, and an integral extension that comprises the port.

8. The wearable audio device of claim 1, wherein the port acoustically couples one of the first acoustic cavity or the second acoustic cavity to an environment external to the wearable audio device, wherein the port comprises a nozzle that is configured to deliver acoustic energy into an ear canal of a user of the wearable audio device.

9. The wearable audio device of claim 1, wherein the first acoustic cavity is located proximate a front of the wearable audio device and the second acoustic cavity is located proximate a rear of the wearable audio device.

10. The wearable audio device of claim 1, wherein the wearable audio device comprises an earbud, wherein the electro-acoustic transducer has an outer dimension equal to or less than approximately 20 mm.

11. A wearable audio device, comprising:

a frame comprising a first acoustic cavity and a second acoustic cavity;

an electro-acoustic transducer within the frame and configured to deliver acoustic energy into the first and second acoustic cavities;

a port integrated in the frame that acoustically couples one of the first or second acoustic cavities to a different volume;

a counter-bore feature in the frame adjacent to the port;

a rib adjacent to the counter-bore feature; and a metal mesh covering the port and attached through the rib proximate to the counter-bore.

12. The wearable audio device of claim 11, wherein the counter-bore feature comprises a ledge in the frame extending at least partially annularly around the port, wherein the ledge is defined by a recess in adjacent walls of the frame, wherein the ledge is located radially inboard of a stake location of the metal mesh relative to a primary axis of the port, and wherein the rib extends at least partially annularly around the port.

13. The wearable audio device of claim 12, wherein the ledge and the rib each extend around an entire annulus of the port.

14. The wearable audio device of claim 11, wherein the frame comprises plastic, wherein the metal mesh is directly bonded to the plastic at the rib proximate to the counter-bore feature by heat staking, wherein the counter-bore feature and the rib mitigate melting of the plastic into the port during the heat staking.

15. The wearable audio device of claim 14, wherein the direct bond between the metal mesh and the plastic at the rib mitigates occlusion of the port.

16. The wearable audio device of claim 11, wherein the port acoustically couples the first and second cavities.

17. The wearable audio device of claim 11, wherein the port is located in an outer wall of the frame, and wherein the rib extends from the outer wall of the frame and is located radially outboard of the counter-bore feature relative to a primary axis of the port.

18. The wearable audio device of claim 11, wherein the port acoustically couples one of the first acoustic cavity or the second acoustic cavity to an environment external to the wearable audio device, wherein the port comprises a nozzle that is configured to deliver acoustic energy into an ear canal of a user of the wearable audio device, and wherein the first acoustic cavity is located proximate a front of the wearable audio device and the second acoustic cavity is located proximate a rear of the wearable audio device.

19. A method comprising:

forming a frame for a wearable audio device comprising a port opening and a counter-bore feature at least partially surrounding the port opening;

placing a metal mesh over the port opening proximate to the counter-bore feature; and heat staking the metal mesh into the frame around the port opening such that at least a portion of the frame melts during the heat staking and is collected in the counter-bore feature without entering the port opening.

20. The method of claim 19, wherein the frame further comprises a rib extending from a wall proximate the port opening, wherein the heat staking comprises heat staking the metal mesh into the rib, and wherein at least a portion of the rib melts during the heat staking and is collected in the counter-bore feature without entering the port opening.

* * * * *